US011767953B2

(12) United States Patent
St.Ives

(10) Patent No.: US 11,767,953 B2
(45) Date of Patent: Sep. 26, 2023

(54) CAST IN-GROUND LIGHTING ASSEMBLY

(71) Applicant: Laurence Robert St.Ives, Las Vegas, NV (US)

(72) Inventor: Laurence Robert St.Ives, Las Vegas, NV (US)

( * ) Notice: Subject to any disclaimer, the term of this patent is extended or adjusted under 35 U.S.C. 154(b) by 526 days.

(21) Appl. No.: 16/440,020

(22) Filed: Jun. 13, 2019

(65) Prior Publication Data

US 2020/0393097 A1 Dec. 17, 2020

(51) Int. Cl.

| | |
|---|---|
| ***F21S 8/02*** | (2006.01) |
| ***F21V 15/01*** | (2006.01) |
| ***F21V 19/00*** | (2006.01) |
| ***F21V 17/10*** | (2006.01) |
| ***F21S 4/28*** | (2016.01) |
| ***F21V 21/005*** | (2006.01) |
| *F21Y 115/10* | (2016.01) |
| *F21W 131/10* | (2006.01) |

(52) U.S. Cl.

CPC ..... *F21S 8/022* (2013.01); *F21S 4/28* (2016.01); *F21V 15/01* (2013.01); *F21V 17/107* (2013.01); *F21V 19/001* (2013.01); *F21V 21/005* (2013.01); *F21W 2131/10* (2013.01); *F21Y 2115/10* (2016.08)

(58) Field of Classification Search

CPC ..... F21S 8/022

See application file for complete search history.

(56) References Cited

U.S. PATENT DOCUMENTS

| | | | | |
|---|---|---|---|---|
| 5,160,202 A * | 11/1992 | Legare | F21S 8/08 | 362/153.1 |
| 6,027,280 A * | 2/2000 | Conners | E01F 9/559 | 362/153.1 |
| 2012/0033422 A1 * | 2/2012 | Jiang | G02B 19/0066 | 362/235 |

* cited by examiner

*Primary Examiner* — Joseph L Williams

(74) *Attorney, Agent, or Firm* — David B Abel

(57) ABSTRACT

A cast concrete durable light fixture design and assembly that will allow in-ground lighting features for roadways, pathways and architectural features providing a simple installation for a drive over in-grade or in-ground lighting fixture. The cast concrete design enables curves and shapes to be manufactured as easily as straight or linear configurations.

19 Claims, 6 Drawing Sheets

CAST IN-GROUND LIGHTING ASSEMBLY

BACKGROUND AND PRIOR ART

In-ground or below grade lighting systems provide a number of desirable benefits and enhancements to building designs and architectural features. In-ground linear lighting can be used to create unobtrusive, directional or decorative illumination in pedestrian or vehicular traffic areas, which will not obstruct traffic. Placing the lighting features in-ground has an added benefit of making the lighting vandal resistant. In-ground lighting can be used to delineate pathways and access points or to direct illumination on architectural structures and facades. However, in-ground lighting systems are exposed to a number of environmental factors, including water, salt water, corrosive materials and chemicals, requiring special design considerations. Examples of in-ground lighting systems are disclosed in U.S. Pat. Nos. 7,478,916; 9,638,381; 9,784,440 and 10,082,260.

In-ground light fixtures intended to be used in roadways, driveways and entrances, which may be called "drive over" lighting fixtures, further require a durable and structurally sound assembly. In-ground drive over resistant lighting fixtures have a shell or body made from metal, often stainless steel or aluminum, where the shell or body is fixed in the ground to be back-filled and surrounded by concrete or pavers. After setting the concrete or pavers around the body, a secondary waterproof sealed lighting fixture is then installed in the body. The strong supporting metal body together with the lighting fixture is then capable of supporting considerable weight of drive over traffic without being distorted or crushed. Stainless steel is usually the preferred material body as it resists corrosive elements which may be present in many soil conditions, or where salt water or chemicals could cause materials such as aluminum to have a galvanic reaction, resulting in corrosion and weakening of the fixture.

The high cost of the metal components and the lighting fixture plus additional costs associated with complicated installation cause the application of existing drive over lighting fixtures to be prohibitively expensive to install for many locations. Existing available inground lighting fixtures are also limited to single cans or in some cases straight line assemblies, as the cost and complexity of manufacturing and installing curved or custom fixtures is more expensive and complex making them impractical. An in-ground lighting structure having a simple yet variable design which could be installed more easily with less associated expense, and which would also resist corrosion, would be beneficial to the industry and could become a preferred option for in-ground lighting systems.

BRIEF DESCRIPTION OF THE INVENTION

The present invention is directed to a cast concrete durable light fixture design that will reduce the parts and materials required and facilitate a simpler installation of a drive over in-grade or in-ground lighting fixture. The cast concrete design enables curves and shapes to be manufactured as easily as straight or linear configurations. Casting fixtures as precast interlocking sections from concrete, polymer concrete mixtures or other non-corrosive structural materials, which will withstand heavy drive over traffic, solves the environmental problems associated with present metal body in-ground lighting system applications in a cost-effective configuration.

The present invention optimizes the advantages of light emitting diode (LED) lights for in-ground lighting architectural products. LED versions can provide colored or color changing effects. The miniature size of LEDs enables the creation of narrow linear images. The long life of the LEDs are particularly suitable for the in-ground applications due to their long useful lifetime as compared to other types of lights, and the LED's require limited maintenance. Recent developments of long flexible LED strips with miniaturized electronics using standard line voltages, which can be run continuously in lengths as long as 300 feet, enable new fixture designs to be created which are free-form as well as straight linear lines. In addition, because of the LED low energy requirements, they can be used economically due to their energy efficiency.

DETAILED DESCRIPTION OF THE INVENTION

Figure 1:
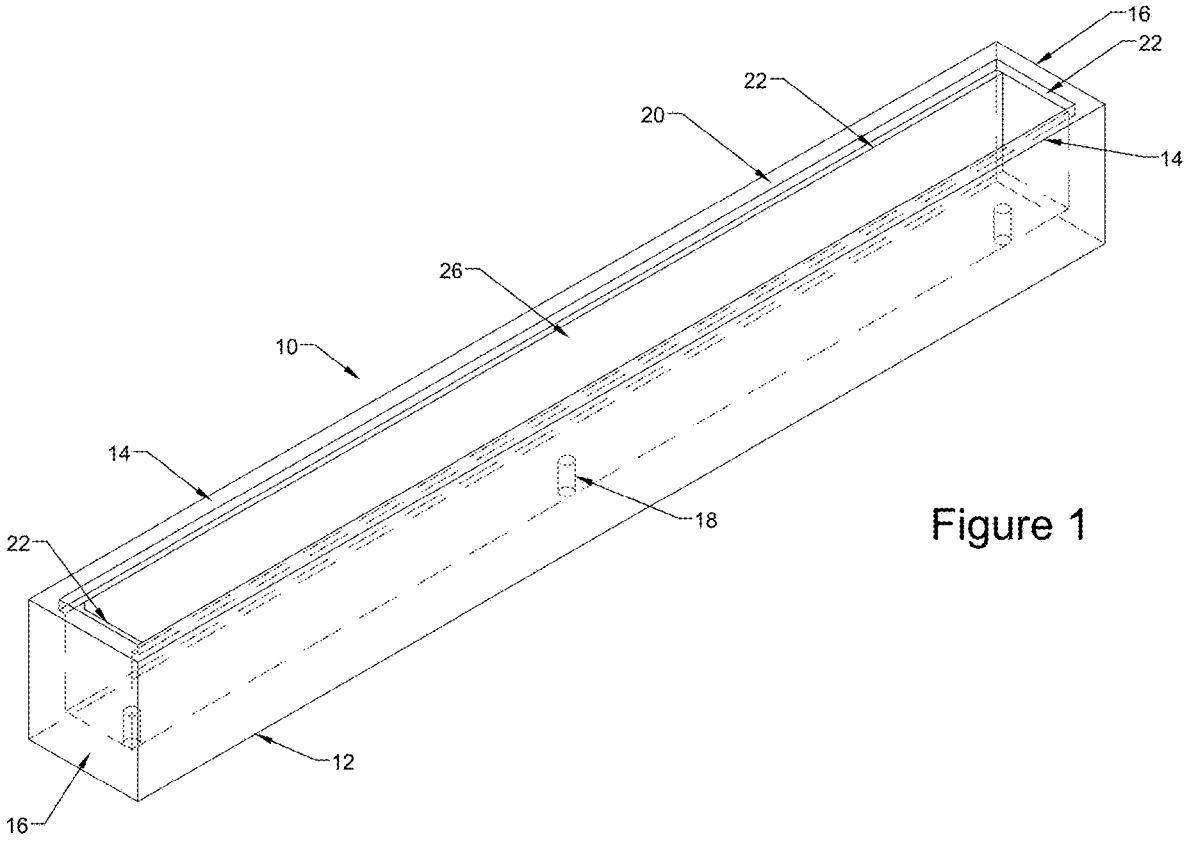
FIG. 1 is a perspective view of a first embodiment of the cast concrete body of an in-ground lighting assembly of the present invention.
Figure 2:
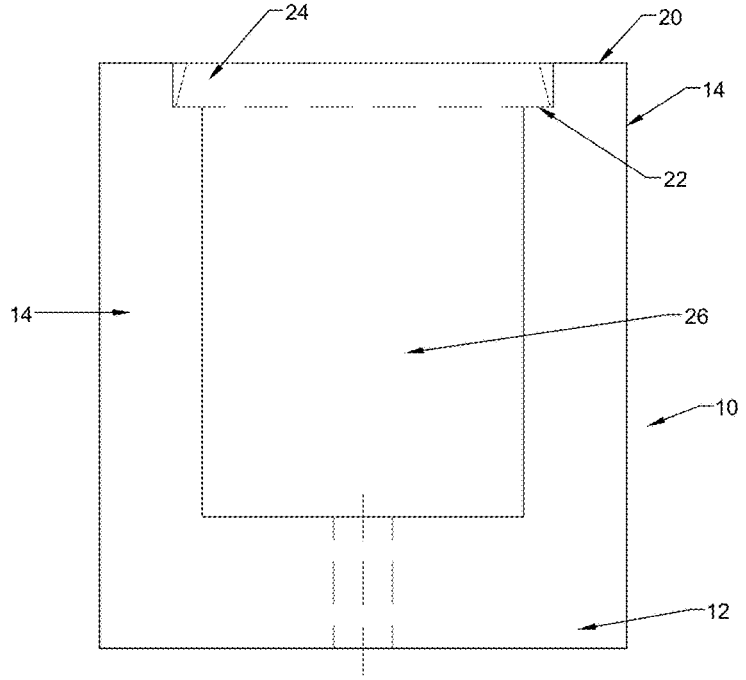
FIG. 2 is an end view of the first embodiment of the cast concrete body of an in-ground lighting assembly of the present invention.

FIG. 1 is a perspective view and FIG. 2 is an end view of a first embodiment of the cast concrete body 10 of an in-ground lighting assembly of the present invention. The cast concrete body 10 includes a base 12 and sidewalls 14 extending upward from the outer edges of the base 12. The cast concrete body 10 may also include endcaps 16. The cast concrete body 10 may be formed in the shape of a square or rectangle with three-quarters of an inch to twelve inch wide base and three-quarters of an inch to six inch tall sides, and up four or even eight feet in length. The base 12 may include one or more drain holes 18 that can also be used to allow wiring access to the interior of the cast concrete body 10. The top edges 20 of the sidewalls 14 as well as the endcaps 16 preferably include a shoulder 22 formed to support the edges of a lens 24, as illustrated in the end view of FIGS. 1 and 2. The base 12 and sidewalls 14 form an open channel 26 for placement of electrical elements including lights, preferably light emitting diode (LED) lighting fixtures, however other types of lighting devices such as liquid crystal displays (LCD) and laser lights may also be incorporated into the channel 26. The cast concrete body 10 is constructed of sufficiently durable materials so as to allow the cast concrete body 10 to be installed in-ground or even in-pavement, with only the upper surface of the lens 24 and top edges 20 of the sidewalls 14 being exposed. The base 12, sidewalls 14 and endcaps 16 of the lighting fixture cast concrete body 10 are formed from concrete, polymer concrete mixtures or other non-corrosive castable or moldable structural materials including high strength plastics and high strength polymers. For in-ground, drive-over installations, the cast concrete body 10 must be capable of supporting a small vehicle, and thus at least 150 kPa (kilo Pascals) and preferably it should be capable of supporting up to 700 kPa to withstand the weight of trucks.

Figure 3:
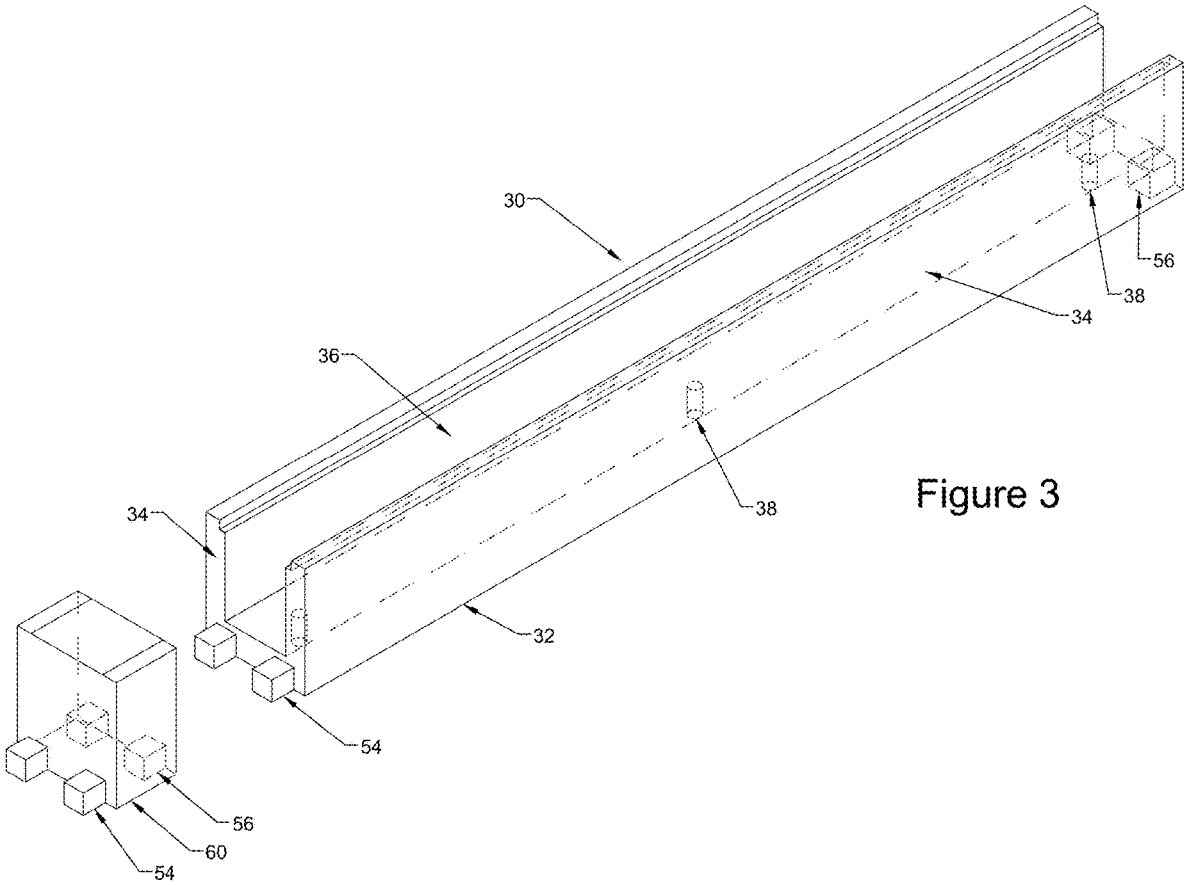
FIG. 3 is a perspective view of a second embodiment of the cast concrete body of an in-ground lighting assembly of the present invention.
Figure 4:
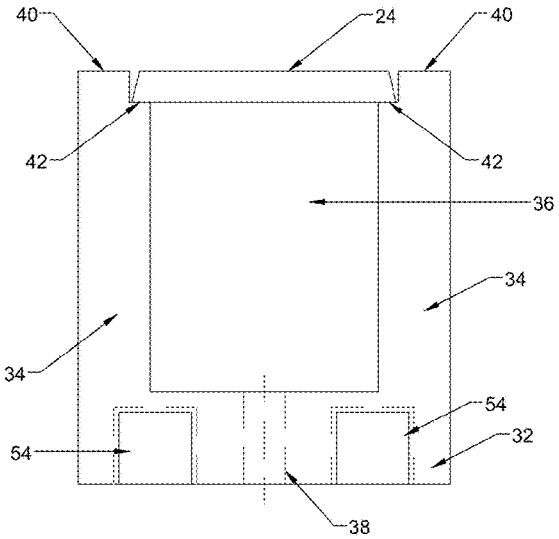
FIG. 4 is an end view of the second embodiment of the cast concrete body of an in-ground lighting assembly of the present invention depicting the channel for LED lighting arrays, drainage hole and interlocking connector feature and lens support ledges.

FIG. 3 is a perspective view and FIG. 4 is an end view of a second embodiment of the cast concrete body 30 of an in-ground lighting assembly of the present invention. The cast concrete body 30 includes a base 32 and sidewalls 34 extending upward from the outer edges of the base 32. The base 32 may include one or more drain holes 38. As depicted in FIGS. 3 and 4, the cast concrete body 30 forms an open-ended channel 36 for receiving the LED lighting arrays. The top surfaces 40 of the sidewalls 34 each include shoulders 42 to support a lens 24. The respective ends 44 and 46 of the cast concrete body 30 preferably include interlocking male 54 and female 56 connector features. The connector features are depicted as having square shapes, although it should be understood that the connector features could have other cross-sectional shapes including round, oval, triangles and rectangular shapes. The connector features allow the easy assembly of two or more of the cast concrete bodies 30 end to end allowing assemblies up to several hundred feet in length. The ends of the cast concrete body 30 may be sealed with endcaps 60 having similar male and female connecting features as necessary to secure the open ends of the channel 36 as illustrated in FIG. 3. The endcaps 60 may also include a shoulder (not shown) to support the end of the elongated lens. In addition, the endcaps may include a hole or punch-out, or they may be drilled, to accommodate wiring for the light devices.

Figure 5A:
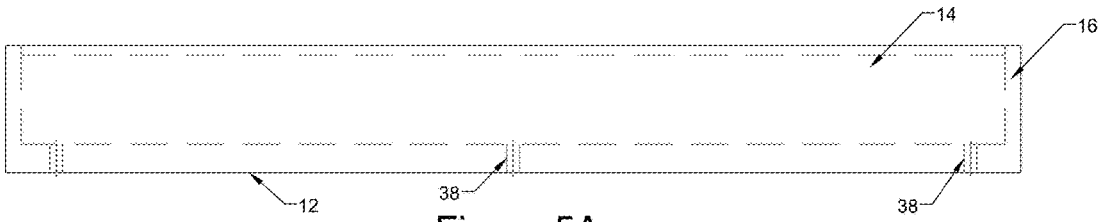
FIG. 5A is a side view of the first embodiment of the cast concrete body of an in-ground lighting assembly of the present invention.
Figure 5B:
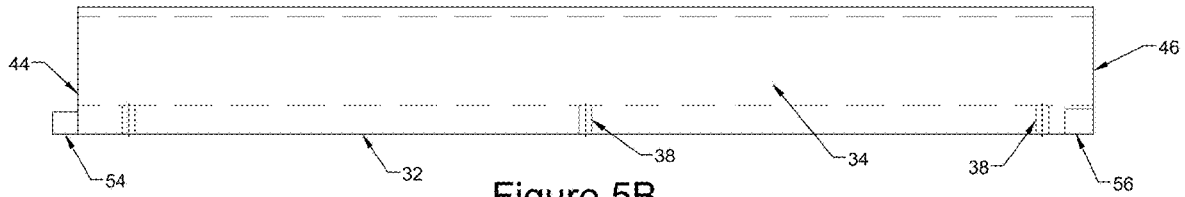
FIG. 5B is a side view of the second embodiment of the cast concrete body of an in-ground lighting assembly of the present invention.
Figure 6A:
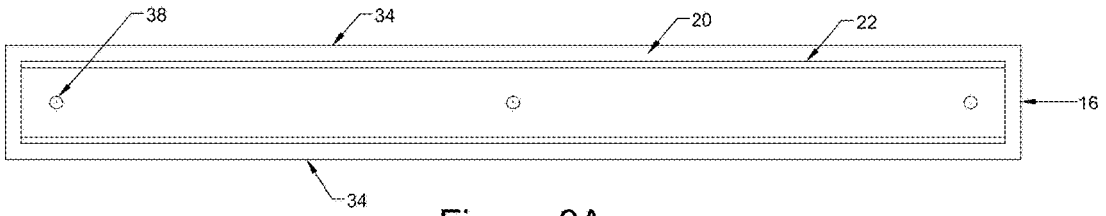
FIG. 6A is a top view of the first embodiment of the cast concrete body of an in-ground lighting assembly of the present invention.
Figure 6B:
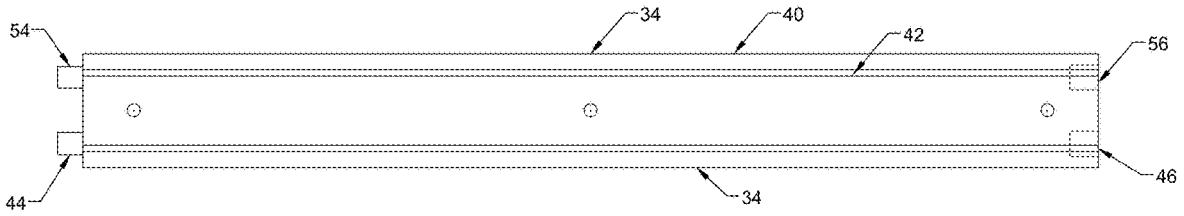
FIG. 6B is a top view of the second embodiment of the cast concrete body of an in-ground lighting assembly of the present invention.

FIG. 5A is a side view of the first embodiment of the cast concrete body 10 and FIG. 5B is a side view of the second embodiment of the cast concrete body 30 of the in-ground lighting assembly of the present invention. FIG. 6A is a top view of the first embodiment and FIG. 6B is a top view of the second embodiment of the in-ground lighting assemblies of the present invention.

As depicted in FIGS. 5A and 6A, the respective ends of the cast concrete body 10 are sealed by the endcaps 16. By comparison, as depicted in FIGS. 5B and 6B, the respective ends of the cast concrete body 30 are open, and the male 54 connecting features extend from the end 44 of the base 32 of the cast concrete body 30. The female 56 connecting features are illustrated by the dashed lines at the end 46 of the base 32 of the cast concrete body 30. It should be appreciated that the cast concrete body 10 of FIGS. 5A and 6A may alternatively be configured to have one end thereof incorporate the open-channel end design of FIGS. 3, 4 and 5B, to terminate the ends of an assembly including one or more of the cast concrete bodies 30.

Figure 7:
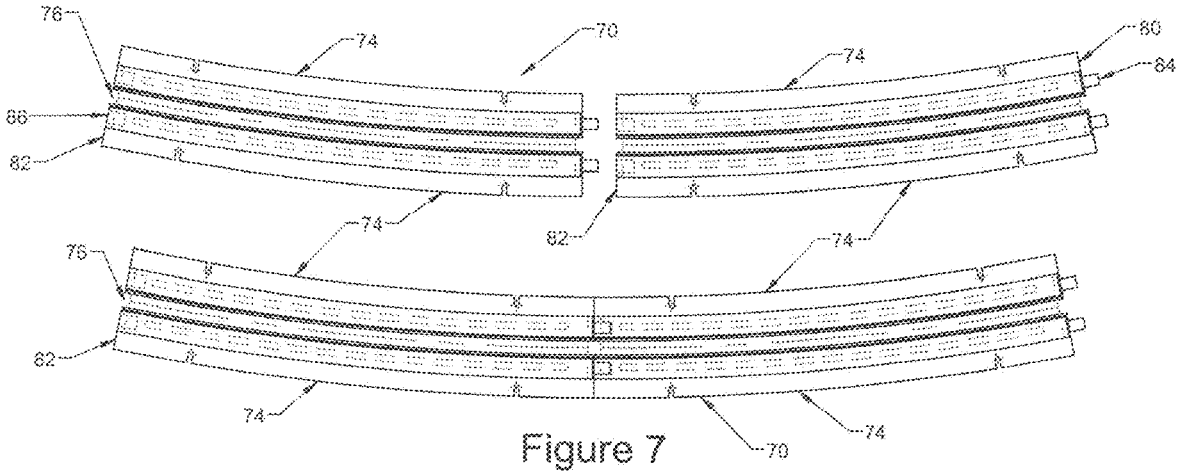
FIG. 7 is a top view of a third embodiment of the cast concrete body of an in-ground lighting assembly of the present invention having a curved design.

FIG. 7 is a top view of a third embodiment of the cast concrete body 70 of an in-ground lighting assembly of the present invention having a curved design. The cast concrete body 70 has a base (hidden in FIG. 7) and sidewalls 74 defining a channel 76 similar to the construction of the above described embodiments. However, the cast concrete body 70 is formed to a curved or arcuate shape as opposed to the linear designs of FIGS. 1 and 3. FIG. 7 thus illustrates the flexibility of the present invention in allowing a non-linear cast concrete body 70 to be formed and joined end-to-end to allow free form designs. The multiple cast concrete bodies 70 depicted in FIG. 7 include respective ends 80 and 82 preferably include interlocking male 84 and female 86 connector features, similar to those described above with respect to FIGS. 3 and 4. FIG. 7 depicts two cast concrete bodies 70 spaced apart in preparation for assembly in the top half of the figure, and two cast concrete bodies 70 joined together in the bottom half of the figure. The end faces of the cast concrete bodies 70 are preferably glued together with a flexible waterproof adhesive and sealant such as MVIS™ Veneer Mortar made by Laticrete International Inc., which allows linear expansion and contraction during climatic changes.

Figure 8A:
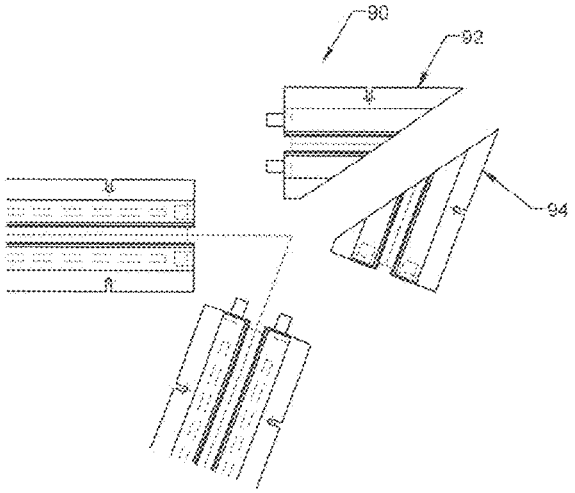
FIG. 8 is a top view of illustrating the steps of forming an angled corner assembly using the cast concrete body of an in-ground lighting assembly of the present invention.
Figure 8B:
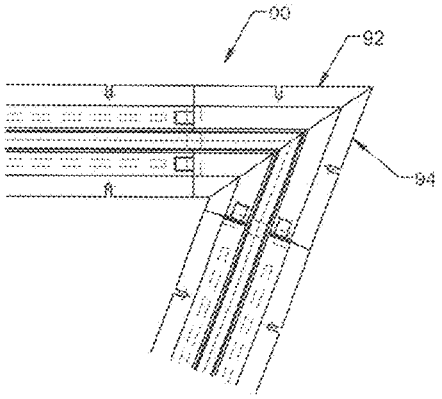

FIGS. 8A, 8B are top views illustrating the steps of forming an angled corner assembly 90 using the cast concrete body 30 described above. The angled corner assembly 90 is formed by cutting one of the cast concrete bodies 30 into three segments, with the two end segments 92 and 94 having opposingly matched angles. The two end segments 92 and 94 are then glued together to form the corner. The angle of the corner can be formed from 180 degrees down to about 20 degrees. The angled corner assembly 90 may require a specially formed or cut lens segment. Alternatively, the angled corner assembly 90 may be sealed with a precast cap formed from the same material used for the cast concrete body 30.

Figure 9:
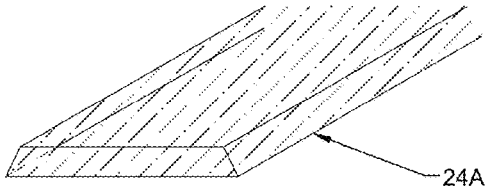
FIG. 9 is a top view of a finished corner assembly formed from the cast concrete body of an in-ground lighting assembly of the present invention.
Figure 10:
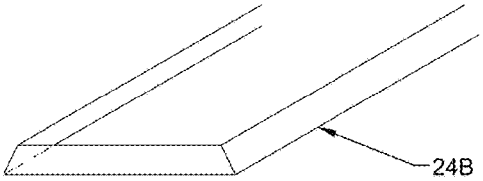
FIG. 10 is a perspective view of a light diffusing lens for the in-ground lighting assembly of the present invention.

FIGS. 9 and 10 illustrate two basic alternative lens designs for the in-ground lighting assembly of the present invention. FIG. 9 illustrates a light diffusing lens 24A that will provide a soft, glowing light. FIG. 10 illustrates a clear lens 24B that provides a more transmissive lens so that the light may be focused on an architectural feature. Each of the lenses 24A and 24B have a generally trapezoidal shape with a width sufficient to fit within the cast concrete body described above, and a length sufficient to extend the length of the cast concrete body. The lenses 24A and 24B may be formed from glass or high strength acrylic, plastic or natural stone material. It will be appreciated by those skilled in the art that various other types of lenses sizes and shapes may be used with the in-ground lighting assembly of the present invention, for example a beam splitting lens to define light bars or a lens having concave or convex upper or lower surfaces to define a diffusing of focusing lens to diffuse or focus the light beam to highlight a specific feature or provide a desired lighting effect. Further, the lens could be formed with refracting structures molded or extruded on the underside of the lens, or the lens may be formed to include microstructures within the lenses to provide specific lighting effects.

Figure 11:
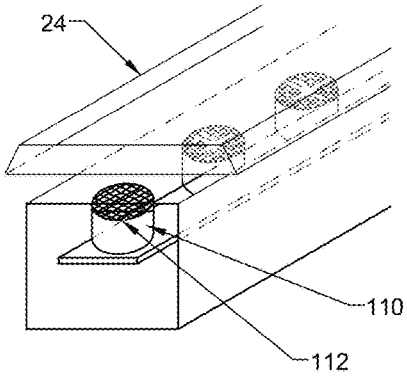
FIG. 11 is a perspective view of an assembly having multiple discrete LEDs for the in-ground lighting assembly of the present invention.
Figure 12:
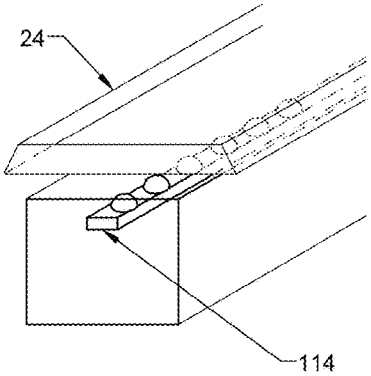
FIG. 12 is a perspective view of a strip LED light assembly for the in-ground lighting assembly of the present invention.
Figures 13, 14:
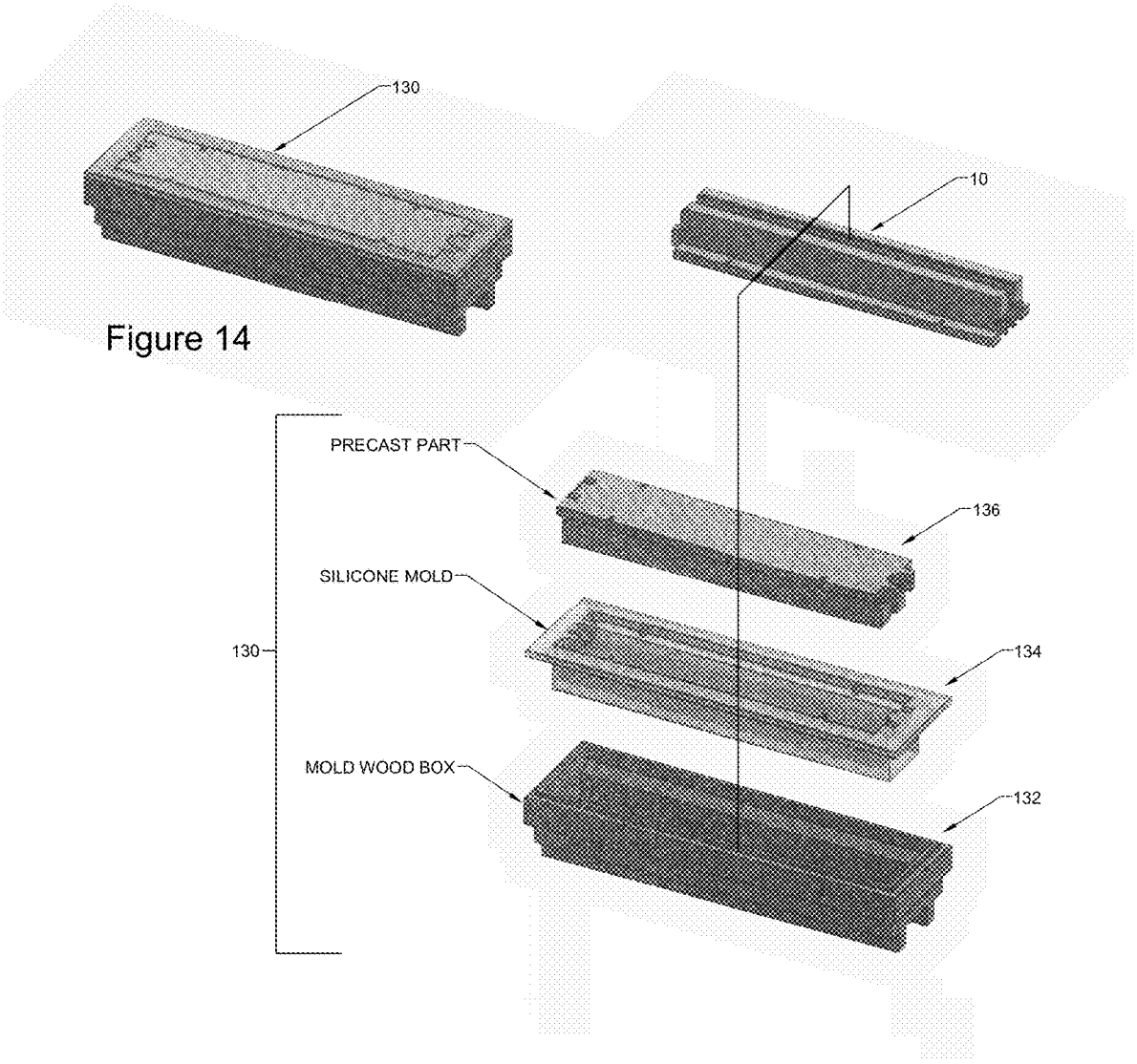
FIG. 13 is a perspective view of a light diffusing lens for the in-ground lighting assembly of the present invention.
FIG. 14 is a perspective view of a mold assembly for casting the concrete body of the in-ground lighting assembly of the present invention.

FIG. 11 is a perspective view of the channel 26 of the in-ground lighting assembly 10 illustrating a sequence of individual light emitting elements 110 or light emitting diodes ("LED") each having a lens 112 that may be shaped to focus or diffuse the light beam, mounted under a clear cover lens 24. FIG. 12 is a perspective view the channel 26 of the in-ground lighting assembly 10 illustrating a LED light strip 114 within the channel 26. The light strip illustrated in FIG. 12 is available in lengths up two several hundred feet long, and when assembled in the in-ground lighting assembly of the present invention they provide a continuous light over substantial lengths and geometries FIG. 13 is a perspective, exploded view of the mold assembly 130 for forming the cast concrete body of the in-ground lighting assembly of the present invention. FIG. 14 is a perspective view of the assembled mold assembly 130 of FIG. 13. The mold assembly 130 includes a mold base 132, a flexible mold 134 and a precast 136. The mold base may be made from wood, plastic or mortar. The flexible mold 134 is preferably formed from a silicon or similar elastomeric material that holds its shape when supported within the mold base 132 and partially filled with concrete. The precast 136 is shaped to fit into the flexible mold 134, and displace the concrete to define all of the top features of the channel body of the cast concrete body 10. The concrete is allowed to cure for 24 to 48 hours within the mold assembly 130. After the concrete cures, the precast 136 is removed and then the remaining mold assembly with the hardened concrete is flipped over, allowing the mold base 132 to be removed. Finally, the flexible mold 134 is removed from the cast concrete body 10. The flexible mold 132 may be left on the cast concrete body 10 to protect it during transportation to an installation location, however the flexible mold 134 is reusable.

The cast concrete bodies 10, 30 and 70 are preferably formed from concrete, polymer concrete mixtures or other non-corrosive castable or moldable structural materials including for example plastics and high strength thermoplastic or resin materials capable of bearing substantial loads. The pre-cast lighting fixture is a self-supporting structure capable of being placed in the ground without additional structural materials or the need to pour concrete in place. Pre-cast lighting fixture sections of various lengths can be interconnected to form infinitely continuous lines of light in roadways, entrances or pathways, without the need for complicated forms or shuttering to be built to set the lights in place. The pre-cast lighting fixture may alternatively be used to house other electronic components for intelligent roadways and pathways, for example housing cellular, wi-fi or other wireless communication technologies enabling vehicular communication and automation.

The pre-cast light fixture define a channel running the full length of the body, with white or light colored reflective sides, which may be angled or shaped to reflect light in a specific pattern. The pre-cast light fixture is designed to contain sealed waterproof LED array or interconnecting arrays or continuous sealed LED strips which may be secured in place by adhesive materials or channels made from plastic or non corrosive metal or other materials, or a secondary channel cast in to the base of the main channel. Each side of the channel preferably has the shoulders or ledges formed to support a flush fitting lens. The lens may be made of plastic or glass or formed from light transmissive materials including natural stone.

Preferably, the lens should be capable of supporting the weight of automobile and truck traffic for in-pavement locations, thus at least capable of supporting 150 kPa to 700 kPa. However, for architectural lighting uses the lens may not need to be capable of supporting vehicular traffic. The lens may be trapezoidal with its narrowest width at the upper position to leave an even space which will allow a sealant or grout material to be applied to secure and seal the lens in position. The main channel within the cast concrete body may have open ends to allow continuous LED lighting arrays or strips to run from section to section of the pre-cast units to create continuous lines of light, or they may have closed ends to seal the fixture as an individual unit. Interlocking connectors and recesses at opposite ends of the fixtures enable fixtures to align and lock together to form continuous linked lines or shapes.

Abutting ends of interconnecting pre-cast sections are glued with a flexible waterproof adhesive/sealant which allows linear expansion and contraction during climatic changes. The linear lighting arrays are secured within the channel, which is enclosed by structural weight bearing plastic or glass lenses, each being longer than a single pre-cast section so that it bridges the joint of each section. The lenses will be supported by load bearing shoulders or ledges which are formed in the pre-cast structure, and are designed to be sealed in place with a waterproof adhesive glue or grout.

Assembly and installation of the cast concrete body sections is achieved by setting the first section on a level bed of sand or other level surface; applying a thin film of adhesive sealant to the end face of the cast concrete body section containing the female interconnector recesses and then placing a second cast concrete body section having the male interconnectors in to place to form a continuous channel. Multiple sections are interconnected until the complete linear or curvilinear light is in place. Open ends are sealed with endcaps, or where circles or similar forms are created the last section is set in place as a keystone after removing the interlocking male interconnectors. Waterproof LED or other illuminating lamps are installed in the channel by appropriate support structures such as formed supports or recesses in the channel, or other secondary supports of non corrosive materials. Liquid tight connectors enable power to be supplied to the lights through round holes cast or drilled into the cast concrete body sections or at the ends of connected runs, and cable routing components enable continuous power connector cords or wire to be run throughout the lighting channel to allow power connections.

Alternatively, the lens 24 of the assembly may be formed as a structural architectural glass having embedded LEDs within the glass. The embedded LEDs are provided with electrical power circuitry within the glass which allows for the design of an illuminating lens capable of color change and being digitally addressed and controlled to display or project messages or images. These types of glass assemblies are currently available and readily adapted to be included as the lens or under a clear lens in the in-ground lighting assembly of the present invention.

Various alternative styles are envisaged where the design details allow for different conditions and finished appearance. The invention has been described in detail above in connection with the figures, however it should be understood that the system may include other components and enable other functions. Those skilled in the art will appreciate that the foregoing disclosure is meant to be exemplary and specification and the figures are provided to explain the present invention, without intending to limit the potential modes of carrying out the present invention. The scope of the invention is defined only by the appended claims and equivalents thereto.

The invention claimed is:

1. An architectural light housing assembly comprising:

a cast body having a base and opposing sidewalls defining an elongated channel, said sidewalls having contoured top edges to support an elongated lens mounted within an upper portion of said elongated channel to seal the upward facing top of said elongated channel;

a sequence of lighting elements placed within the length of the elongated channel; and endcaps affixed to the ends of the base and sidewalls to enclose opposite ends of the elongated channel, wherein said cast body and endcaps are formed from a castable material selected from the group consisting of concrete, a polymer concrete mixture, high strength plastic and high strength polymer.

2. The architectural light housing assembly of claim 1, wherein the base of the cast body is 0.75 to twelve inches wide and the sidewalls are 0.75 to six inches tall.

3. The architectural light housing assembly of claim 1, wherein said cast body is two feet to eight feet long.

4. The architectural light housing assembly of claim 1, further comprising:

male connecting features formed on at least one end of said cast body female connecting features formed on an opposite end of said cast body, said male or female connecting structures having a square, round, oval, triangles or rectangular shape, and said respective male connecting features engage with said female connecting features to form a continuous open channel.

5. The architectural light housing assembly of claim 1, wherein said cast body, elongated lens and endcaps can support a load exceeding 150 kPa.

6. The architectural light housing assembly of claim 1, wherein said base includes at least one drain hole to allow moisture to escape from said channel directly into the ground.

7. The architectural light housing assembly of claim 1, wherein said sidewalls further comprise:

a shoulder on the upper interior edge of the sidewall to support said lens within said channel; and a sealant applied between outer edges of said lens and said shoulder of said sidewalls.

8. The architectural light housing assembly of claim 1, wherein said sequence of lighting elements further comprises: a strip of light emitting diodes extending the length of said elongated channel.

9. The architectural light housing assembly of claim 1, wherein said elongated lens has a trapezoidal cross-sectional shape and said lens is formed from a clear or frosted glass or high strength acrylic, plastic or natural stone material.

10. The architectural light housing assembly of claim 1, wherein said elongated lens further comprises: a concave or convex upper or lower surfaces to define a diffusing of focusing lens to diffuse or focus the light beam.

11. The architectural light housing assembly of claim 1, wherein said elongated lens further comprises: refracting structures molded or extruded on the underside of the lens.

12. The architectural light housing assembly of claim 1, wherein said elongated lens is formed to include microstructures within the lens to provide specific lighting effects including text and images.

13. An architectural light housing assembly comprising:

a plurality of cast concrete bodies each having a base and opposing sidewalls defining an elongated channel, said sidewalls having a contour feature to support an elongated lens mounted within an upper portion of said elongated channel;

male connecting features formed on at least one end of each of said plurality of cast concrete bodies and female connecting features formed on the opposite ends of said plurality of cast concrete bodies, said male and female connecting features allowing said plurality of cast concrete bodies to be assembled end to end to form a continuous elongated channel with said end faces of said cast concrete bodies being glued together with a flexible waterproof adhesive and sealant;

a sequence of lighting elements placed within the length of the elongated channel; and endcaps affixed to respective ends of said plurality of cast concrete bodies to enclose opposite ends of the elongated channel, wherein said cast body and endcaps are formed from a castable material selected from the group consisting of concrete, a polymer concrete mixture.

14. The architectural light housing assembly of claim 13, wherein said male or female connecting structures having a square, round, oval, triangles or rectangular shape.

15. The architectural light housing assembly of claim 13, wherein said plurality of cast concrete bodies are shaped to define a straight, arcuate, curving, or angled elongated continuous open channel extending from end to end of said plurality of cast concrete bodies.

16. The architectural light housing assembly of claim 13, wherein said cast concrete bodies, elongated lens and endcaps can support a load exceeding 150 kPa.

17. The architectural light housing assembly of claim 13, wherein said elongated lens has a trapezoidal cross-sectional shape and said lens is formed from a clear or frosted glass or high strength acrylic, plastic or natural stone material.

18. The architectural light housing assembly of claim 13, wherein said elongated lens is formed to include microstructures within the lens to provide specific lighting effects including text and images.

19. The architectural light housing assembly of claim 13, wherein said elongated lens further comprises: a concave or convex upper or lower surfaces to define a diffusing of focusing lens to diffuse or focus the light.

* * * * *